US009192279B1

(12) United States Patent
Valle et al.

(10) Patent No.: US 9,192,279 B1
(45) Date of Patent: Nov. 24, 2015

(54) CONTAINER SYSTEM FOR WASHING CARS

(76) Inventors: Chris Valle, Miami, FL (US); Chris Angelo, Miami Lakes, FL (US)

( * ) Notice: Subject to any disclaimer, the term of this patent is extended or adjusted under 35 U.S.C. 154(b) by 0 days.

(21) Appl. No.: 13/435,533

(22) Filed: Mar. 30, 2012

Related U.S. Application Data

(60) Provisional application No. 61/470,851, filed on Apr. 1, 2011.

(51) Int. Cl.
*A47L 13/50* (2006.01)
*A47L 13/58* (2006.01)

(52) U.S. Cl.
CPC ..... *A47L 13/58* (2013.01)

(58) Field of Classification Search
USPC ..... 220/486, 607, 735, 760, 904, 773–776, 220/782, 765, 318, 322, 710.5, 705; 15/260, 264; 215/397
See application file for complete search history.

(56) References Cited

U.S. PATENT DOCUMENTS

| | | | | | |
|---|---|---|---|---|---|
| 1,698,915 | A | * | 1/1929 | Kircher | 220/762 |
| 2,798,758 | A | * | 7/1957 | Yakopec | 294/68.26 |
| 2,879,916 | A | * | 3/1959 | Hoffmann et al. | 220/322 |
| 3,633,815 | A | | 1/1972 | Rosenburg, Jr. | |
| 3,756,451 | A | * | 9/1973 | Popeil | 220/736 |
| 4,295,680 | A | * | 10/1981 | Grasso | 297/188.09 |
| 4,351,165 | A | | 9/1982 | Gottsegen et al. | |
| 4,351,448 | A | * | 9/1982 | Ingersoll et al. | 220/318 |
| 4,551,988 | A | | 11/1985 | Petrantoni | |
| 5,113,881 | A | | 5/1992 | Lin et al. | |
| D328,551 | S | | 8/1992 | Kong | |
| D329,806 | S | | 9/1992 | Kindt | |
| 5,447,252 | A | * | 9/1995 | Ward | 220/756 |
| 5,501,241 | A | | 3/1996 | Jacobson | |
| 5,816,485 | A | | 10/1998 | Bernstein | |
| 5,927,304 | A | | 7/1999 | Wen | |
| 5,938,276 | A | * | 8/1999 | Munoz et al. | 297/188.12 |
| D427,857 | S | | 7/2000 | Mulhauser et al. | |
| 6,237,765 | B1 | * | 5/2001 | Hagen et al. | 206/315.11 |
| 6,389,638 | B1 | * | 5/2002 | Dickinson et al. | 15/261 |
| D462,881 | S | | 9/2002 | Mulhauser et al. | |
| 7,025,880 | B2 | * | 4/2006 | Lamb | 210/238 |
| D530,989 | S | | 10/2006 | Mellen et al. | |
| 8,108,963 | B2 | * | 2/2012 | Griot et al. | 15/264 |
| 8,336,160 | B2 | * | 12/2012 | Chen | 15/260 |
| 2008/0179214 | A1 | * | 7/2008 | Hall | 206/579 |
| 2012/0228316 | A1 | * | 9/2012 | West | 220/735 |

* cited by examiner

*Primary Examiner* — Anthony Stashick
*Assistant Examiner* — Robert Poon
(74) *Attorney, Agent, or Firm* — Malloy & Malloy, P.L.

(57) ABSTRACT

A container system for washing cars includes a base container, which may include wheels, rollers, etc., for mobility, which is structured to contain a cleaning solution during a car washing operation. A basket having a grate is positionable into the base container, and is structured to filter out particulate matter from the cleaning solution during a washing operation, and to provide a means for air circulation to one or more cleaning accessories stored thereon upon completion. A cover container is provided which is cooperatively structured with the base container to operatively engage one another in a closed configuration, for transport and storage, along with a plurality of cleaning accessories stored therein. The cover container may be utilized as a seat or step stool by the user during a car washing operation. At least one handle is provided and is structured to at least facilitate positioning of the container system.

10 Claims, 4 Drawing Sheets

CONTAINER SYSTEM FOR WASHING CARS

CLAIM OF PRIORITY

The present application is based on and a claim of priority is made under 35 U.S.C. Section 119(e) to a provisional patent application in the U.S. Patent and Trademark Office, namely, that having Ser. No. 61/470,851 and a filing date of Apr. 1, 2011, and which is incorporated herein by reference in its entirety.

BACKGROUND OF THE INVENTION

1. Field of the Invention

The present invention is directed to a multi-purpose container system intended for use primarily in washing a car, truck, or other vehicle, but which can also be used for cleaning a variety of other objects. The inventive container system is readily disposable between an open operative orientation during use, and a closed configuration for transport and/or storage of same, along with a plurality of cleaning accessories readily disposed therein.

2. Description of the Related Art

Since the advent of the automobile over a hundred years ago, numerous individuals as well as businesses have undertaken the task of washing and/or otherwise cleaning the interior and exterior of their vehicle(s) or those of their customers. In the United States, many people have seen and are familiar with local neighborhood car wash events hosted by school children, or other organizations, to raise funds for various non-profit sponsored events. In addition, most Americans are also familiar with the simple way of washing their cars, namely, taking an open bucket or pail and filling it with water and a small amount of cleaning solution, such as liquid soap or a specialty automobile cleaning solution, and then using a rag, sponge, and/or cleaning cloth which is dipped in and out of the bucket in order to clean the exterior of the vehicle. Thereafter, the vehicle is then rinsed with clean water, and in many cases, one or more towels are used to dry the vehicle after it has been washed.

Upon completing a car washing operation utilizing the open bucket or pail as described above, the used cleaning solution is poured out, such as down a drain, and the bucket or pail, sponge and/or cloths, etc., are rinsed with clean water, whereupon the towels, rags, etc., are oftentimes hung on the side of the pail, and/or the sponge is deposited inside the pail or bucket. Thereafter, the bucket of pail, and its contents, are sometimes placed on a driveway or other ground surface to dry or as is perhaps more common, placed in a garage, storage closet, or even the trunk of a car to dry. In many of such instances, however, it is unfortunately common for mold or mildew to form in or on the sponge, towel, rag, etc. Further, it is not uncommon for the open bucket or pail to be knocked over by accident, which has the effect of dislodging the contents i.e., the sponge, cleaning solution, towels or rags, sometimes causing them to get dirty from the surfaces they touch.

As such, it would be beneficial to provide a container system for washing cars, and other vehicles or objects, which is readily disposable between an open operative orientation, in which a cleaning solution can be at least temporarily contained to allow a user to perform a car washing operation, as well as a closed configuration in which all of the cleaning supplies, such as, towels, rags, sponges, and cleaning solution, etc., could be securely contained for transport and or storage. It would be further beneficial for any such container system to incorporate one or more handles for ease of positioning the container system during a car washing operation, as well as to facilitate temporary placement of cleaning towels, brushes, etc., during washing or an initial drying period. It would also be advantageous for any such system to permit air circulation therethrough while disposed in a closed configuration, in order to facilitate drying of the cleaning accessories, once again, cloths, rags, sponges, etc., thereby inhibiting, or even eliminating the formation of mold and mildew on the cleaning accessories. Yet another benefit maybe gained from any such a container system by providing a component which would allow a user to sit or stand thereon during a car washing operation, so as to facilitate completion of the same.

SUMMARY OF THE INVENTION

The present invention is intended to address these and other needs which remain in the art and as such, comprises a multipurpose container system for washing cars which is structured to be easily disposed between a closed configuration, such as for transport and storage of a plurality of cleaning accessories, and open configuration, to facilitate a car washing operation.

More in particular, the container system includes a base container having a closed bottom end and an open top end. The base container is structured to at least temporarily contain an amount of a cleaning solution during a car washing operation. A base handle is attached to the base container via a handle mount, and facilitates a user's positioning of the base container during a car washing operation, as well as to facilitate transport and storage of the container system upon completion of the same. In at least one embodiment, the base container includes a plurality of wheels, rollers, etc., to further facilitate the mobility of the base container and/or container system by the user.

A basket assembly is provided and is structured and disposed to be removably positioned into and out of the base container. In at least one embodiment, the basket assembly comprises a basket having a grate structured and disposed to substantially overlie the closed bottom end of the base container, while the basket is disposed in an operable position in the base container. A basket handle may be provided to facilitate positing the basket into and out of the base container, as necessary. The grate is structured to permit a free flow of liquid therethrough, as well as to allow small particulate matter which may be transferred to the cleaning solution during a car washing operation to settle out into the closed bottom end of the base container, below the grate, so as to reduce or prevent the reintroduction of the particulate matter to a cleaning cloth, rag, sponge, etc., which may potentially scratch the surface of a vehicle being washed. The grate is further structured to prevent the passage of objects of a predetermined minimum dimension, such as, by way of example only, cleaning rags, clothes, sponges, brushes, etc.

The container system of the present invention further comprises a cover container having a closed upper end and an open lower end. The open lower end of the cover container and the open top end of the base container are cooperatively structured and disposed to operatively engage one another in a closed configuration. Further, in at least one embodiment, the base handle is structured to releasably lock the cover container to base container in the closed configuration, for transport and storage of the present container system, along with the plurality of cleaning accessories stored therein.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As stated above, the present invention comprises a container system for washing cars, generally shown as 10 throughout the figures. As will be appreciated from the following detailed description, the container system 10 of the present invention is structured to serve multiple needs, including storage and transport of cleaning accessories such as, but not limited to, cleaning solutions, waxes, polishes, rags, towels, clothes, sponges, brushes, squeegees, etc., as well as facilitating use of the cleaning accessories during a car washing operation. While described herein as a container system 10 for washing cars, it will be further appreciated from the following disclosure that the container system 10 of the present invention may be utilized for the storage, transport, and utilization of cleaning supplies for other purposes including, but not limited to, washing windows, patio equipment, whether grills, furniture and the like, pool areas, outdoor sporting equipment, etc., wherein a liquid cleaning solution is at least temporarily contained, and one or more towel, rag, squeegee, brush, etc., is utilized to facilitate the cleaning process.

Figure 1:
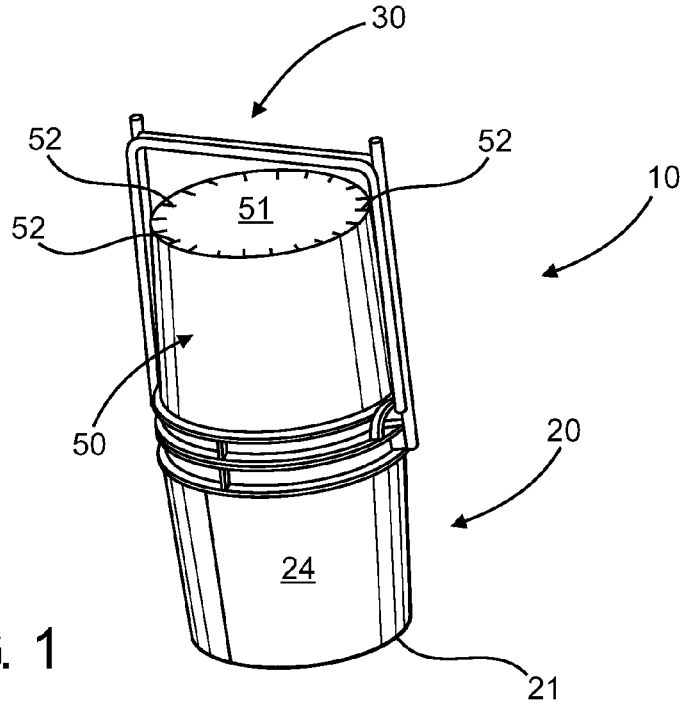
FIG. 1 is a perspective view of one illustrative embodiment of a container system for washing cars in accordance with the present invention.

FIG. 1 is illustrative of one embodiment of a container system 10 for washing cars in accordance with the present invention. More in particular, FIG. 1 is illustrative of a container system 10 disposed in a closed configuration to facilitate transport or storage of the same, along with one or more cleaning accessories stored inside. The container system 10 includes a base container 20 and a cover container 50 which are cooperatively structured and disposed to operatively engage one another in the closed configuration, as shown in FIG. 1. A base handle 30 is provided and, as is the case with a number of other components of the present container system 10, the base handle 30 serves a multiplicity of functions. As shown in FIG. 1, base handle 30 serves to releasably secure the cover container 50 to the base container 20 in the closed configuration. Further, base handle 30 provides a means for lifting base container 20, with or without cover container 50 operatively engaging the same.

Figure 2:
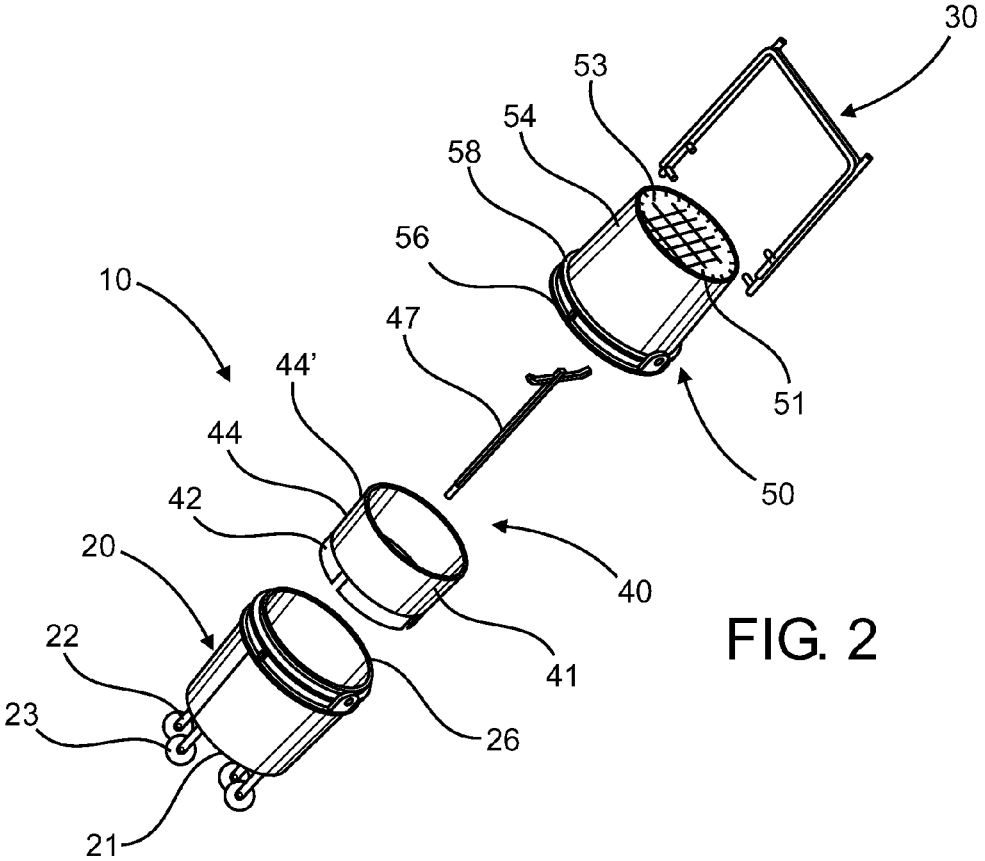
FIG. 2 is an exploded perspective view of another illustrative embodiment of a container system for washing cars in accordance with the present invention.

FIG. 2 is an exploded perspective view illustrative of another embodiment of a container system 10 for washing cars in accordance with the present invention. As before, the container system 10 comprises a base container 20, the base container 20 having a closed bottom end 21 and an open upper end 26, and as will be appreciated from the figures presented herein, the base container 20 is structured to at least temporarily contain an amount of a cleaning solution for use during a car washing operation.

In the illustrative embodiment of FIG. 2, the base container 20 further comprises a plurality of wheels 23 mounted to the closed bottom end 21 via wheel mount 22. It will be appreciated that the wheel mount 22 may comprise a singular structure carrying a plurality of wheels 23 connected to or interconnected with the closed bottom end 21 of base container 20. It will be appreciated by those of ordinary skill in the art that one or more wheels such as at 23 can be attached in other ways to the base 20 to allow the inventive container system to be easily moved about before, during and/or after a washing operation. In at least one alternative embodiment, such as is illustrated in FIG. 2, a plurality of wheel mounts 22 may be provided, each wheel mount 22 interconnecting a different one of the plurality of wheels 23 to the closed bottom end 21 of base container 20.

FIG. 2 further illustrates one embodiment of a basket assembly 40 in accordance with the present invention. In particular, basket assembly 40 includes a basket 41 and basket handle 47, which is removably interconnected to at least a portion of the basket 41 and is structured, in part, to facilitate positioning of the basket 41 into and out of base container 20. As shown in FIG. 2, basket 41 includes a base 42 and a side wall 44, and has a substantially open upper end 44'. Basket assembly 40 will be discussed in greater detail below, with particular reference to FIGS. 5 and 6.

The container system 10 for washing cars of the present invention further includes a cover container 50, as previously noted. As shown in FIG. 2, cover container 50 includes a closed upper end 51 and a side wall 54. FIG. 2, is further illustrative of an embodiment of the present container system 10 wherein cover container 50 comprises a friction surface 53 on the outer surface of the closed upper end 51. Specifically, in at least one embodiment, the friction surface 53 comprises a raised pattern on the outer surface of the closed upper end 51 of the cover container 50 having an anti-skid pattern which is structured to prevent the user's shoes or feet from slipping or sliding while the user stands thereon. FIG. 2 further illustrates that, in at least one embodiment, the cover container 50 includes a number of stiffening rings 58, ideally positioned proximate to the open lower end 56, wherein the stiffening rings 58 are structured and disposed to provide structural integrity to the cover container 50 sufficient to support the weight of a person standing thereupon. FIG. 2 also illustrates an embodiment of a base handle 30 in accordance with the present invention, and is discussed in greater detail below with specific reference to FIG. 8.

Figure 3:
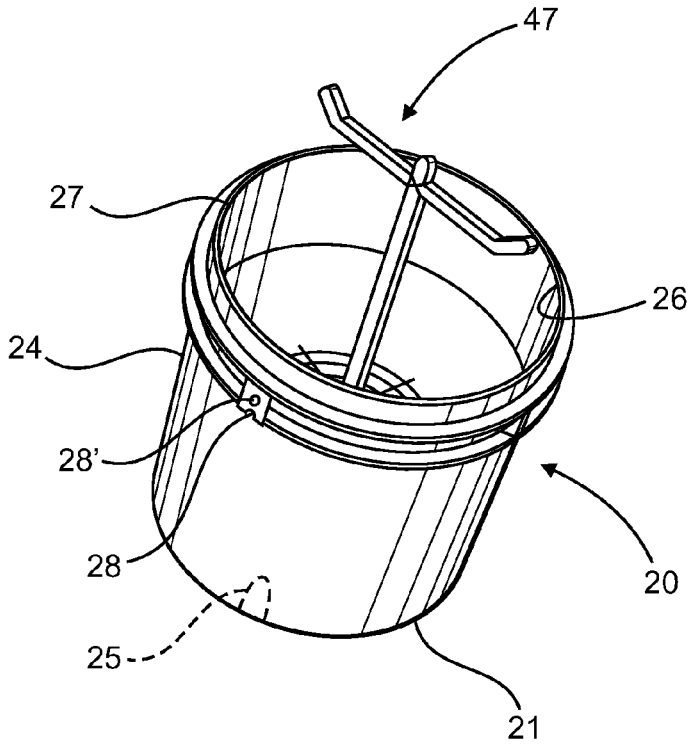
FIG. 3 is a perspective view of one embodiment of a base container in accordance with the present invention.

Looking next to FIG. 3, a perspective view is representative of one embodiment of a base container 20 disposed in an open operative orientation in accordance with the present invention. As before, the base container 20 comprises a closed bottom end 21 and an open upper end 26, and as may be seen from FIG. 3, the base container 20 is structured to at least temporarily contain an amount of the cleaning solution for use during the car washing operation. The base container 20 includes at least one side wall 24 disposed between the closed bottom end 21 and the open upper end 26. As illustrated throughout the figures, side wall 24 of base container 20 preferably comprises a single, continuous cylindrical surface.

However, it is within the scope and intent of the present invention for the base container 20 to comprise a plurality of sidewalls 24 which would thereby form a square, rectangular, or other polygonal geometric configuration. Further, base container 20 may comprise a side wall having an oval or elliptical configuration. FIG. 3 further illustrates one embodiment of a handle mount 28 and a handle interlock 28' cooperatively disposed and structured to interconnect the base handle 30 to the base container 20 in an operative orientation.

In at least one embodiment, the base container 20 of the present container system 10 is manufactured from a thermoplastic resin, such as high density polyethylene, or similar thermoplastic or other such materials exhibiting similar structural integrity, as well as being similarly lightweight and inexpensive to manufacture. In at least one further embodiment, each component of the present container system 10 is manufactured from high density polyethylene, or similar material, as noted above. The use of such material facilitates manufacture of the container system 10 of the present invention, such as via well established and economical thermoplastic injection molding process.

Figure 4:
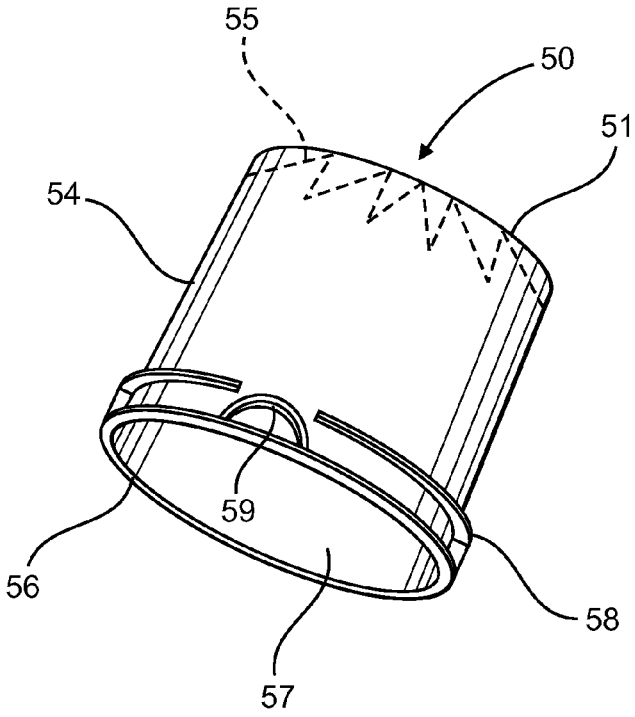
FIG. 4 is a perspective view of one embodiment of a cover container in accordance with the present invention.

Turning to FIG. 4, a perspective view of one embodiment of a cover container 50 in accordance with the present invention is presented. As may be seen from FIG. 4, the cover container 50 includes a closed upper end 51 and an open lower end 56, having a side wall 54 disposed therebetween. As with base container 20, the cover container 50 as illustrated throughout the figures is shown to comprise a single, continuous cylindrical side wall 54. However, it is also within the scope and intent of the present invention for cover container 50 to comprise any of a plurality of additional geometric configurations including polygonal, having a plurality of side walls 54, provided that a cover periphery 57 is cooperatively structured to operatively engage a base periphery 27 so as to permit the open top end 26 of base container 20 to operatively engage the open lower end 56 of cover container 50 in a closed configuration, such as is illustrated in FIG. 1. It will be appreciated from the foregoing that, although not strictly required, the geometric configuration of the cover container 50 in accordance with the present invention essentially conforms to the geometric configuration of the corresponding base container 20.

FIG. 4 further illustrates the cover container 50 having at least one stiffening ring 58 ideally disposed about the outer periphery proximate the lower open end 56. As previously stated, the stiffening ring 58 is structured and disposed to provide sufficient structural integrity to the cover container 50 so as to withstand the weight of a person standing or sitting upon the closed upper end 51. In at least one further embodiment, the cover container 50 may comprise a plurality of inner stiffening members 55 inside and proximate the closed upper end 51. As with stiffening rings 58, stiffening members 55 are structured and disposed to provide sufficient structural integrity to the cover container 50, so that a person may sit upon or stand on the closed upper end 51.

Figure 5:
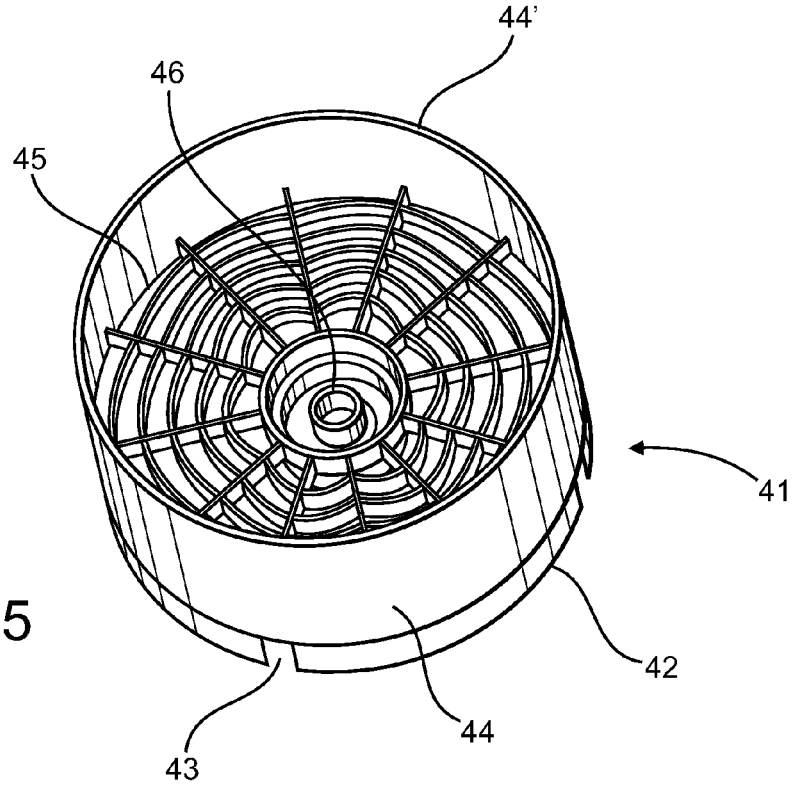
FIG. 5 is a perspective view of one embodiment of a basket in accordance with the present invention.
Figure 6:
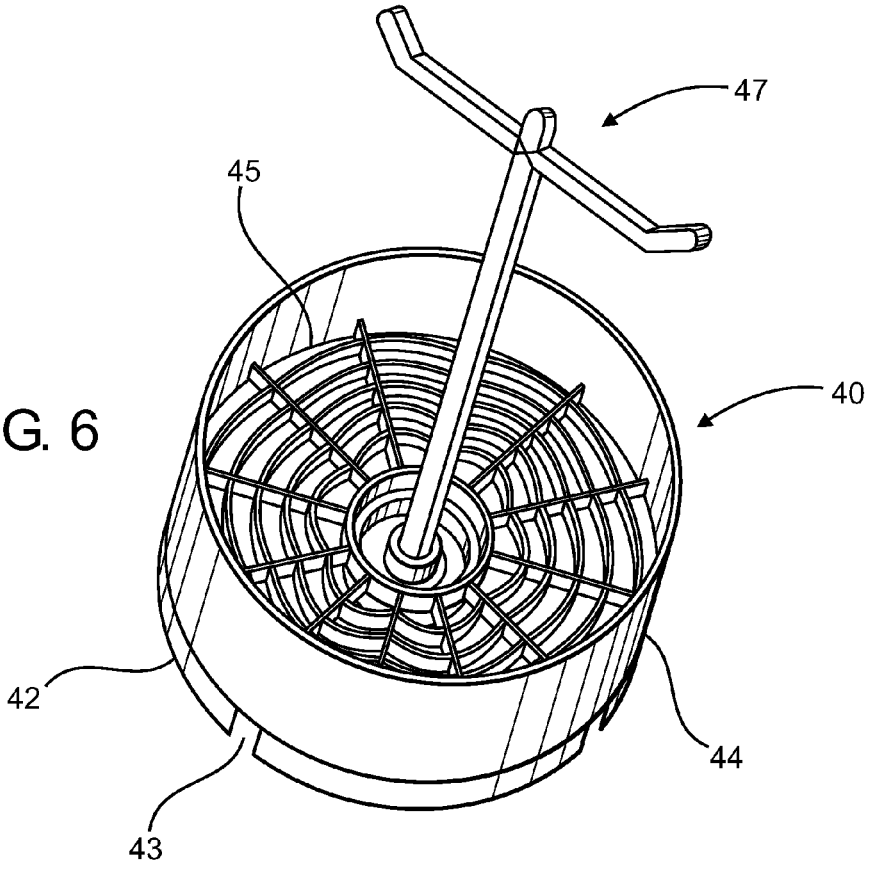
FIG. 6 is a perspective view of one embodiment of a basket assembly in accordance with the present invention.

FIGS. 5 and 6 are representative of one embodiment of a basket 41 and a basket assembly 40, respectively, in accordance with the present invention. Looking first to FIG. 5, basket 41 comprises a base 42 and a side wall 44 extending upwardly therefrom, terminating in an open upper end 44'. FIG. 5 further illustrates a grate 45 disposed proximate the base 42 of basket 41, the grate 45 is structured to inhibit the passage of objects having a predetermined minimum dimension therethrough, such as, rags, towels, sponges, brushes, and other cleaning accessories. In at least one embodiment, the grate 45 is structured to inhibit passage of objects having pre-determined minimum dimension in the range of about 0.25 (¼") to 075 (¾") inches or even approximately an inch.

As will be appreciated, while the grate 45 is structured to prevent the passage of relatively large cleaning products and/or accessories from passing therethrough, the grate 45 is also structured to facilitate the passage of cleaning solution, and thus, serves as a debris screen which will allow potentially damaging particulate matter to drop through an amount of a cleaning solution in base container 20, and into the closed bottom end 21 of the base container 20, below the grate 45. As such, the potential of scratching a surface of a vehicle being washed with particulate matter inadvertently adhered to a cleaning accessory, such as a cleaning rag, towel or sponge, is substantially minimized.

Grate 45 further serves to permit air circulation into the closed bottom end 21 of base container 20 to facilitate drying of cleaning accessories such as, once again, cleaning rags, towels, sponges, etc., which may be stored in the base container 20 on grate 45 of basket 41, including while the container system 10 is disposed in a closed configuration for transport or storage. As illustrated best in FIG. 1, the closed upper end 51 of cover container 50 comprises a plurality of apertures 52 structured and disposed to further facilitate air circulation within the container system 10 while base container 20 and cover container 50 are disposed in a closed configuration with one another. As will be appreciated, by providing for air circulation to dry cleaning accessories stored within the present container system 10 while it is disposed in a closed configuration, the occurrences of mold and/or mildew forming on the cleaning accessories is greatly reduced, if not eliminated altogether.

The base 42 of basket 41 in at least one embodiment, comprises one or more basket positioning slots 43 structured to align with one or more basket positioning tabs 25, such as is illustrated in FIG. 3. The basket positioning slot(s) 43 and basket positioning tab(s) 25 are cooperatively structured to minimize movement of basket 41 while it is disposed in an operative orientation in base container 20, such as is shown in FIG. 3.

Figure 7:
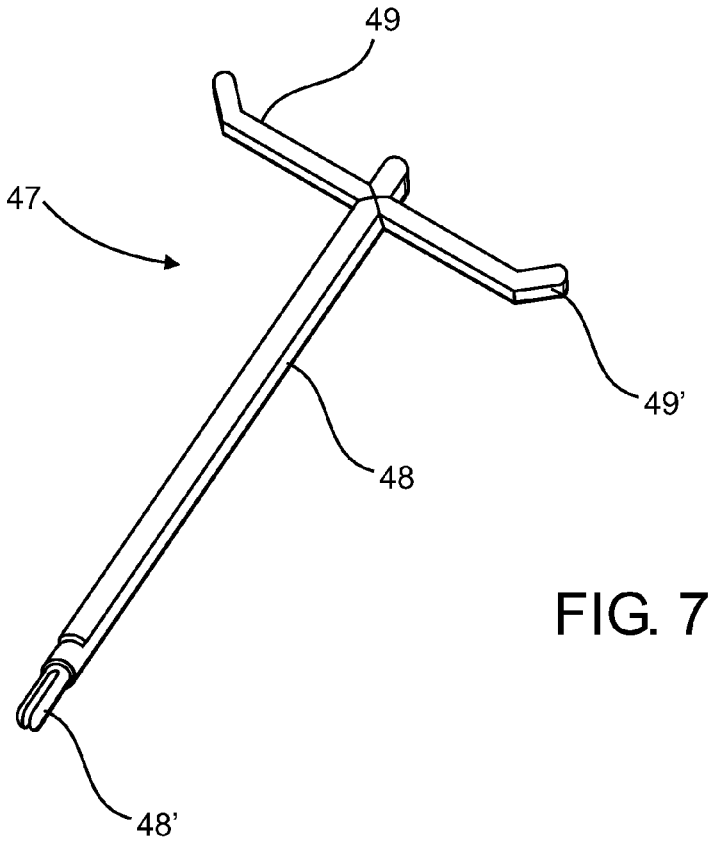
FIG. 7 is a perspective view of one embodiment of a basket handle in accordance with the present invention.

FIG. 5 illustrates a handle interconnect 46 disposed in the center of grate 45 which is structured to facilitate the interconnection of basket handle 47 to basket 41, such as is illustrated in FIG. 6. FIG. 7 is illustrative of one embodiment of a basket handle 47 having a riser 48 structured to extend upwardly in substantial vertical orientation from basket 41, and more in particular, grate 45, and a basket interconnect 48' structured to snap-fit into handle interconnect 46 of the basket 41. Further, FIG. 7 is illustrative of a cross member 49 disposed at the upper end of basket handle 47. Cross member 49 is configured to allow a plurality of cleaning accessories including, but not limited to, towels, rags, clothes, etc., to be hung therefrom without sliding or otherwise falling off, to facilitate a user's access to the same during a car washing operation. In at least one embodiment, cross member 49 may have one or more angled ends 49' structured to serve as hooks to allow brushes or other items to be hung therefrom so as to facilitate their accessibility for use in washing a vehicle. The angled end or ends 49' further serve to prevent cleaning accessories such as towels, rags, or wipes from sliding off the end of cross member 49. Cross member 49 may also be utilized to hang one or more towels, rags, clothes, etc., therefrom for an initial drying period, prior to placement into base container 20 for transport or storage.

Figure 8:
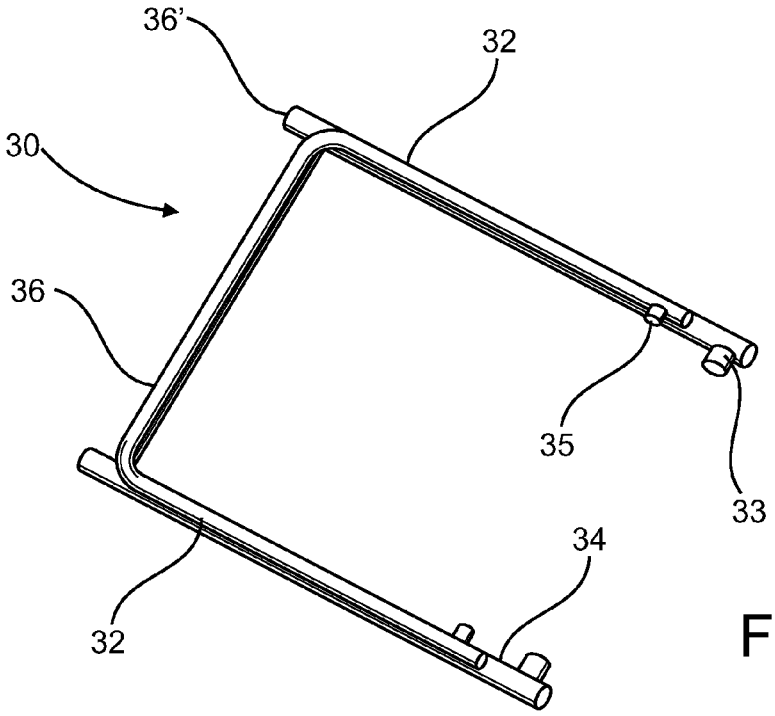
FIG. 8 is a perspective view of one embodiment of a base handle in accordance with the present invention.

FIG. 8 is illustrative of one embodiment of a base handle 30 in accordance with the present invention. In the embodiment of FIG. 8, the base handle 30 comprises a plurality of spaced apart side arms 32 having a cross support 36 interconnected therebetween. Similar to cross member 49 of basket handle 47, the cross support 36 of base handle 30 is structured to facilitate hanging cleaning accessories, such as, towels, rags, wipes, etc., therefrom. Further, in at least one embodiment, base handle 30 comprises one or more riser 36' extending upward from cross support 36 so as to prevent cleaning accessories, once again, towels, rags, wipes, etc., from sliding off of cross support 36. It is within the scope and intent of the present invention for either base handle 30 or basket handle 47 to include one or more hooks to allow cleaning brushes or other cleaning accessories to be readily hung therefrom, once again, to facilitate accessibility during a car washing operation. Further, either base handle 30 or basket handle 47, or both, may include a dispenser for paper towels or other such rolled type cleaning product(s). As such, base handle 30 and basket handle 47 are cooperatively structured and disposed to provide a user with a full array of options for positioning cleaning accessories to be utilized by the user during a car washing operation.

FIG. 8 further illustrates base handle 30 including a container mount 33 structured and disposed to interconnect with handle mount 28 of base container 20. In at least one embodiment, container mount 33 is structured to snap-fit into handle mount 28, and to be movable therein. FIG. 8 further illustrates base handle 30 having at least one stop 34, which is positioned and disposed to cooperatively engage handle interlock 28' when base handle 30 is disposed in a substantially perpendicular orientation relative to closed bottom end 21 of base container 20. Furthermore, FIG. 8 illustrates lock member 35 which is cooperatively structured and disposed to engage cover interlock 59 of cover container 50, when cover container 50 is disposed in an operative engagement with base container 20 in a closed configuration, once again, as shown in FIG. 1. As such, lock member 35 serves to securely yet releasably retain cover container 50 in the closed configuration with base container 20 during storage and/or transport of the plurality of cleaning accessories which the user may store in basket 41 disposed inside of base container 20. As will be appreciated, once again, with reference to FIG. 1, base handle 30 is structured and disposed to be retained in a substantially perpendicular orientation relative to closed bottom end 21 of base container 20, while base container 20 is disposed in a closed configuration with cover container 50, thereby facilitating easy access for a user to grasp and transport the container system 10 for washing cars in accordance with the present invention.

Stop(s) 34 and lock member(s) 35 are further structured to prevent movement of the base handle 30 beyond approximately forty-five degrees from the substantially perpendicular orientation relative to closed bottom end 21 of the base container 20. More in particular, when stop 34 disengages from handle interlock 28', and, in the event cover container 50 is disposed in an operative orientation with base container 20, lock member 35 disengages from cover interlock 59, the base handle 30 is free to rotate in a downward direction. However, stop(s) 34 and lock member(s) 35 are structured to extend inwardly and engage a portion of the open top end 26 of the base container 20, thereby prohibiting movement of the base handle 30 beyond the aforementioned forty-five degree angle of rotation.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A container system for use in washing a vehicle, comprising:

a base container having a closed bottom end and an open top end a base handle attached to said base container via a handle mount, said base handle comprising at least one stop, said stop extending inwardly and engaging a portion of an open top end of said base container when said base handle is rotated downwards to said base container, thereby prohibiting movement of said base handle beyond an angle of rotation, a basket assembly structured and disposed to be removably positioned into said base container, said basket assembly comprising a base, an enclosed sidewall extending upwardly therefrom, terminating in an open upper end, a grate supported by said base, and a basket handle extending upwardly from said grate, said grate structured and disposed to substantially overlie upon, and in spatial relation to, said closed bottom end of said base container, said grate being structured to permit a free flow of liquid therethrough, a cover container having a closed upper end and an open lower end, wherein said open lower end of said cover container and said open top end of said base container are cooperatively structured and disposed to operatively engage one another in a closed configuration, said closed upper end and open lower end of said cover container dimensioned in sufficient spatial relation to one another to substantially enclose at least one item taller than said base container stored therein, when said cover container is disposed in an operative engagement with said base container, and said base handle structured to releasably lock said cover container to said base container in said closed configuration.

2. The system as recited in claim 1 wherein said angle of rotation is approximately forty five degrees from the substantially perpendicular orientation relative to said open top end of said base container.

3. The system as recited in claim 1 wherein said base handle comprises at least one lock member, said at least one lock member engaging at least one cover interlock of said cover container when said base handle is in a substantially perpendicular orientation relative to said closed bottom end of said base container, thereby releasably locking said cover container to said base container.

4. The system as recited in claim 1 wherein said basket handle comprises at least one riser, at least one cross member with at least one angled end, and at least one hook.

5. The system as recited in claim 1 wherein said base handle comprises a cross support, at least one riser and at least one hook.

6. The system as recited in claim 1 wherein said cover container comprises a plurality of apertures structured to facilitate air flow and evaporation of fluids while said base container and said cover container are disposed in said closed configuration.

7. The system as recited in claim 1 wherein said cover container comprises a height dimension that is at least 25% the height dimension of said base container.

8. The system as recited in claim 1 wherein said cover container comprises a height dimension that is at least 50% the height dimension of said base container.

9. The system as recited in claim 1 wherein said cover container comprises a height dimension that is at least 75% the height dimension of said base container.

10. A container system for use in washing a vehicle, comprising:

a base container having a closed bottom end and an open top end, said base container structured to at least temporarily contain an amount of a cleaning solution, a base handle attached to said base container via a handle mount, said base handle comprising at least one stop, said stop extending inwardly and engaging a portion of said open top end of said base container when said base handle is rotated downwards to said base container, thereby prohibiting movement of said base handle beyond an angle of rotation, a basket assembly structured and disposed to be removably positioned into said base container, said basket assembly comprising a base, an enclosed sidewall extending upwardly therefrom, terminating in an open upper end, a grate supported by said base, and a basket handle extending upwardly from said grate, said grate structured and disposed to substantially overlie upon, and in spatial relation to, said closed bottom end of said base container, said grate being structured to permit a free flow of liquid therethrough, a cover container having a closed upper end and an open lower end, wherein said open lower end of said cover container and said open top end of said base container are cooperatively structured and disposed to operatively engage one another in a closed configuration, said cover container comprising at least one cover interlock structured and positioned so as to receive at least one lock member of said base handle, when said base handle is in a substantially perpendicular orientation and when said cover container and said base container are disposed in said close configuration, and said cover container comprising a height dimension that is at least 25% the height dimension of said base container.

* * * * *